United States Patent [19]

King

[11] Patent Number: 4,685,560

[45] Date of Patent: Aug. 11, 1987

[54] DOOR HOOK RETAINER LOOP PATCH

[75] Inventor: William L. King, Denver, Colo.

[73] Assignee: Samsonite Corporation, Denver, Colo.

[21] Appl. No.: 831,759

[22] Filed: Feb. 20, 1986

[51] Int. Cl.[4] ..... A45C 5/06; A45C 5/12; A45C 13/10; A45C 13/34

[52] U.S. Cl. ..... 206/287.1; 206/293; 190/119; 24/698; 292/DIG. 48

[58] Field of Search ..... 206/287, 287.1, 479, 206/293, 292; 383/86, 86.1; 190/100, 119, 27; 150/118; 24/265 H, 265 AL, 30.5, 698; 292/341.18, 253, DIG. 48

[56] References Cited

U.S. PATENT DOCUMENTS

| | | | |
|---|---|---|---|
| 754,558 | 3/1904 | Greves | 206/479 X |
| 1,265,331 | 5/1918 | Holland | 206/479 |
| 1,574,192 | 2/1926 | Gutterman | 206/479 |

*Primary Examiner*—William Price
*Assistant Examiner*—Sue A. Weaver
*Attorney, Agent, or Firm*—Gregory W. O'Connor

[57] ABSTRACT

Garment bags often include a door hook depending from the strap at one end of the bag to hold the bag in an extended linear condition while suspended from the top edge of a door or the like. It has been known to use this hook and strap combination to hold the garment bag in a closed or suitcase configuration. While such closure systems have been somewhat effective, such systems have been known to inadvertently release the door hook. Such closure systems have had substantial aesthetic and manufacturing problems. The disclosed closure system includes a door hook retainer loop patch which is simple to manufacture and forms an interesting and pleasing design element of the overall bag. This patch comprises a rectangular patch base fixedly attached to one end of the garment bag. This patch base has a length of webbing passing in a sinuous path through a series of aligned slots to present an aligned series of equal sized and spaced hook retaining loops. Preferably this patch includes a compressible foam insert captured between the patch base and the wall of the garment bag. This foam insert provides a biasing force which grips the hook between one of the loops and the adjacent patch base, thus reducing the tendency of the hook to fall from the loop during its bag closing functioning.

4 Claims, 5 Drawing Figures

DOOR HOOK RETAINER LOOP PATCH

This invention relates to Luggage and specifically to closure systems for holding certain softsided luggage pieces, such as garment bags, in the closed or folded condition.

BACKGROUND OF THE INVENTION

Garment bags are notorious types of luggage for carrying clothing, usually on hangers. The garment bags are made of flexible fabric material to permit the bags to be folded at least once to form a package the size and shape of a large suitcase for relatively easy carrying. Virtually all such garment bags include closure systems for holding the garment bag in this closed or folded condition. Such systems have included one or more buckles spanning the gap between the top and bottom ends of the bag to hold the bag in a U-shape condition.

More recently, a garment bag marketed by the Samsonite Corporation, Denver, Colo. has utilized the door hook that is normally provided on such bags to support the garment bag in its open condition from the top edge of a door and the like to be used alternately as a part of the closure system for the bag. In this garment bag, the door hook depends from a strap, chain or the like from top end of the garment bag. When used as the closure system, this chain or strap is extended from the top end of the folded bag towards the bottom end and inserted through a loop of webbing material riveted to an outside surface of the bottom end of the bag. Thus the door hook retained close to the bag, thus preventing the door hook from inadvertently becoming entangled or dragging on the floor. This system also eliminates the necessity for providing additional snap hooks, buckles, etc. to hold the bag in a closed condition.

However, the loops of webbing have been less than effective in retaining the hook under all conditions. Sometimes when the bag is jarred or less than optimum tension is placed on the hook such as when the garment bag is not fully packed with clothing, the hook will fall from its resting place in the webbing loop. Also, the riveted loop or loops do not present a very aesthetic configuration.

It has been also found that manufacture of this hook retaining loop is quite time consuming since it employs a number of manufacturing steps, specifically the cutting, stitching, riveting, etc.

BRIEF SUMMARY OF THE INVENTION

Accordingly, a door hook retainer loop patch of the instant invention is constructed to more optimally retain the door hook when the door hook is operatively positioned to close the garment bag, presents an acceptable visual impression, and is relatively easy to manufacture. Specifically, the instant invention provides a door hook retainer loop patch for use as a closure system which includes a door hook for a garment bag. This patch comprises a patch base of a generally flexible laminer material. A series of slots is provided through this patch base and webbing is passed in and out of the series of slots in a sinuous path so as to form a plurality of loops on one side of the patch base. Stitching is provided for holding the webbing in place in this sinuous path and for holding the patch base to the garment bag or the like. These loops which project to one side of the patch base are sized to selectively receive and hold the hook of the closure system when the hook is utilized to hold the garment bag in a closed condition.

This patch base preferably has a generally rectangular planer shape and the stitching for retaining the patch base on the garment bag follows the perimeter of the rectangular shape of the patch base.

It is also preferred that the stitching for holding the webbing in a sinuous path be positioned adjacent to and parallel with at least one of the slots in the series of slots. To provide a choice of positions for retaining the hook in this closure function, such as when the garment bag has differing amounts of clothing packed therein, each of the loops in the series of loops is spaced substantial distance from the adjacent loop, the webbing thus passing between the patch base and the garment bag or the like for that distance between these adjacent retaining loops. For strength and durability purposes it is desirable that the stitching for retaining the webbing in this sinuous path passes through the patch base and through at least a wall of the garment bag. In order to enhance the hook retaining function of the loops it is desirable to provide a foam insert positioned between the patch base and the wall of the garment bag whereby a restoring resiliency is provided to grip the hook when the hook is received in on of the loops. Also disclosed is a garment bag and the like which includes a closure system which comprises a strap attached to a first end of the garment bag, a door hook depending from the remote end of the strap, and a door hook retainer loop patch fixedly attached to the other end of the garment bag. This patch includes a patch base stitched at its perimeter to this other end of the garment bag, a series of slots arranged in parallel fashion along with substantial length with the patch base and the length of webbing passing in a sinuous path through the series of slots from the first side of the patch base through each said slot to the other side of the patch base. Loop retaining stitching passes through at least the patch base and the webbing to retain the webbing in this sinuous path and to retain the loops on the first side of the patch base. The loops are sized to receive the hook and retain the hook when the strap and hook are extended from the first end of the garment bag to this patch to retain the garment bag in a closed condition.

It is preferred that a compressable foam insert be included. This foam insert is positioned between the patch base and the wall of the portion of the garment bag to which the patch base is stitched.

DETAILED DESCRIPTION OF THE PREFERRED EMBODIMENT

Figure 1:
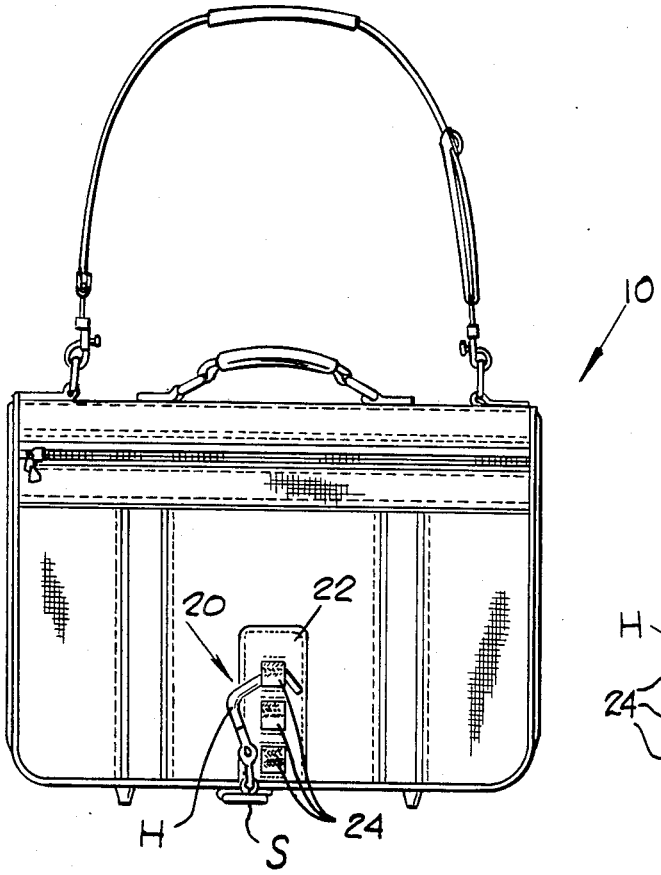
FIG. 1 is a plan view of a garment bag or the like incorporating the door hook retainer loop patch of the instant invention.

FIG. 1 shows a garment bag or the like 10 which incorporates a door hook retainer loop patch 20 on one end, termed the bottom end, of the garment bag. A door hook H is shown retained in one of the loops 24 protruding or projecting from the outside face of the patch 20. Patch base 22 has a generally rectangular planer shape which in the preferred embodiment extends from the edge of the garment bag to the point intermediate the end of the garment bag and the shoulder strap bearing portion shown at the top of FIG. 1.

Figure 2:
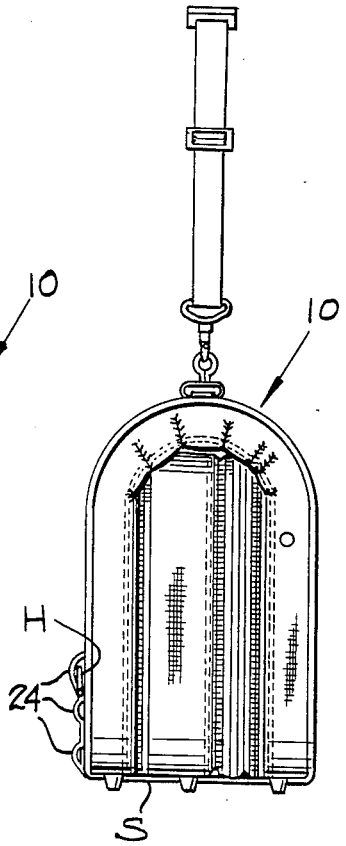
FIG. 2 is an end view of the garment bag or the like of FIG. 1.

FIG. 2 is a view of the right hand end of the garment bag 10. Here it can be seen that the strap S extends from a first or, the upper end of the garment bag, across the bottom of the garment bag (as defined in its closed or carrying condition) to the hook H which is retained at the other or lower end of the garment bag by one of the loops 24.

Figure 3:
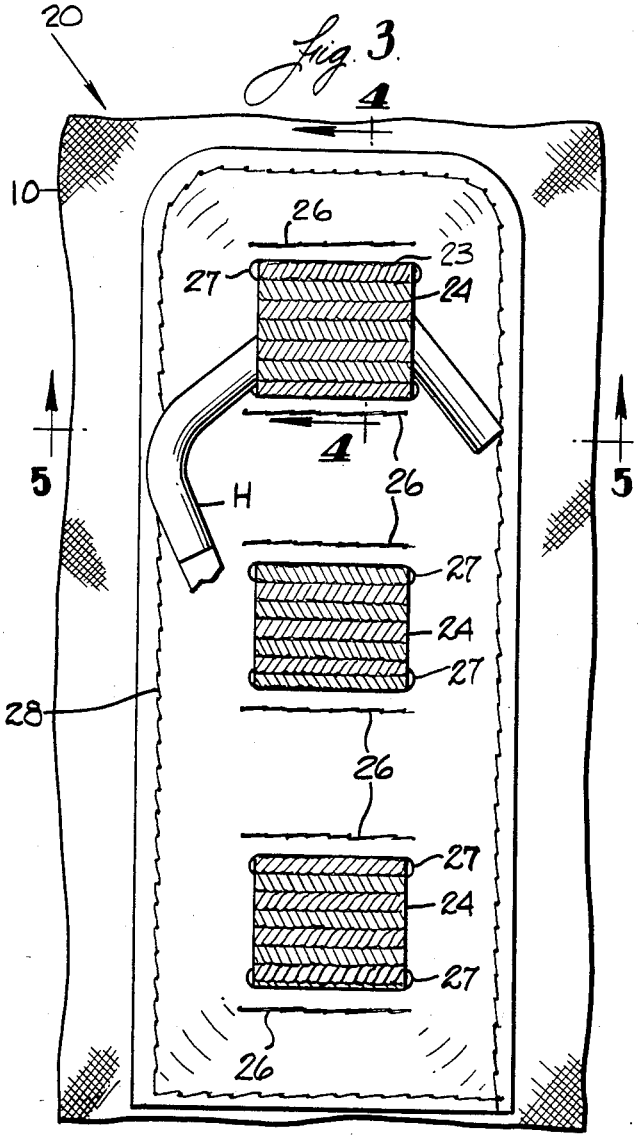
FIG. 3 shows a portion of a wall of the garment bag of FIG. 1, including the door hook retainer loop patch.

FIG. 3 shows the retainer patch 20 in greater detail, with only a portion of the garment bag 10 shown for simplicity. The portion shown is a wall of the garment bag usually constructed of a nylon and polyester woven cloth with a lining or waterproofing provided. Patch 20 comprises a patch base 22 of leather or a simulated leather of a plasticized vinyl. Patch base 22 is preferably a rectangular shape or the other shapes depending on the aesthetic requirements are contemplated. Through the patch base 22 are a series of slots 27 aligned in a series and parallel with one another. Through the slots 27 passes a preferably continuous strip of webbing 23. Webbing 23 traverses a sinuous path from beneath this patch base 22 through the first slot 27 (shown at the upper portion of FIG. 3) forming a loop and passing down through the next slot 27 beneath the patch base a predetermined distance and then back up through the next slot 27 and so on until a plurality of loops 24 are defined.

In order to retain the webbing in this sinuous path and to retain the series of loops 24, stitching 26 is provided. The stitching, 26 passes through the patch base 22 and through the webbing itself. Preferably however, for strength purposes each line of stitching 26 passes through not only the patch base 22 and webbing but also on through the wall of the garment bag 10. As can be seen in FIG. 3, a stitching 26 is positioned approximately to and parallel with each of the slots 27. Stitching 28 is also provided for retaining the patch base to the bag 10. Preferably the stitching 28 conforms with and is parallel with the perimeter or outside edge of the patch base 22.

Figure 4:
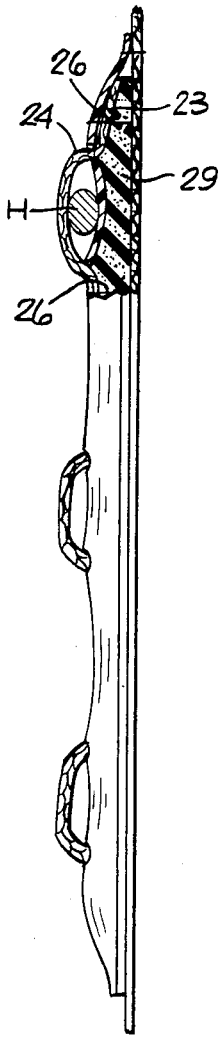
FIG. 4 is a side view of FIG. 3 including a sectional view taken along line 4—4 showing the construction of the patch.

Details of this structure can be seen in FIG. 4. Here stitching 26 is shown to pass through all the layers of the patch and including the wall of the bag 10.

Figure 5:
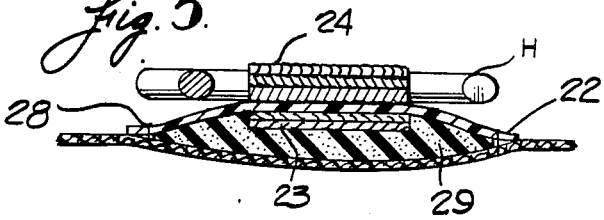
FIG. 5 is a sectional view taken along line 5—5 of FIG. 3.

It has been found desirable to include an insert 29, preferably of a resilient foam material between the patch base 22 and wall of the garment bag 10 (see FIGS. 4 and 5). The stitching 26 also passes through this foam insert. This foam insert has the incidental but also desirable result of giving a pleasing contour to the patch base. This contour enhances the pleasing aesthetic design feature that the patch incidentally provides. A portion of the door hook H is shown in each of the FIGS. 3 through 5. The functioning of the door hook retainer loop patch is illustrated here. Specifically, each loop 24 is dimensioned to snugly receive the door hook H. While the door hook H is shown to be in the uppermost loop 24, any of the loops 24 may be selected, depending on how much clothing has been packed in the garment bag. Clearly if a great deal of clothing is contained, the strap S is stretched quite taut even when the hook H is placed in the lowermost loop 24.

In any event when the door hook is placed through any one of the loops 24 the inextensibility of the webbing which constitutes the loop 24 causes the foam insert 29 immediately beneath the hook to be compressed. The compressed portion of the foam insert exerts a biasing force which grips and thus better holds the hook H in the selected loop 24.

Other materials and configurations are contemplated by the instant invention. For example while a plurality of loops are shown, a single loop with its biasing resilient foam insert may be adequate for some purposes. Also the choice of materials for the patch base 22 and the webbing 24 are not critical to the basic operation of the instant invention although these materials have been chosen for superior durability and visual appeal.

I claim:

1. A door hook retainer loop path for use in a closure system which includes a door hook for a garment bag and the like comprising a patch base of a generally flexible laminar material, a series of slots through said patch base, webbing, passing out one of such slots and back in another of said slots in a sinuous path so as to form at least one loop on one side of said patch base, stitching for holding said webbing in place and in said sinuous path, and a foam insert positioned between said patch base and a wall of said garment bag to which said patch is attached, said loop being sized to selectively receive and hold the hook of said closure system when the hook is utilized to hold the garment bag in a closed condition, said stitching passing through said patch base, said webbing, said insert and said wall of said garment bag, whereby a restoring resiliency is provided by said foam insert to grip said hook when said hook is received in said loop.

2. A door hook retainer loop patch as set forth in claim 1 wherein said patch base has a generally rectangular planar shape, and stitching for retaining said patch base is provided at the perimeter of said rectangular shape of said patch base.

3. A door hook retainer loop patch as set forth in claim 1 wherein said stitching for holding said webbing is positioned adjacent to and parallel with said slots.

4. A door hook retainer loop patch as set forth in claim 1, including at least three of said loops on one side of said patch base.

* * * * *